US008267813B2

(12) United States Patent
Vestuti et al.

(10) Patent No.: US 8,267,813 B2
(45) Date of Patent: Sep. 18, 2012

(54) LACROSSE HEAD AND STICK

(75) Inventors: Ricardo Vestuti, Providence, RI (US); Chad Wittman, Boston, MA (US)

(73) Assignee: Reebok International Limited, London (GB)

( * ) Notice: Subject to any disclaimer, the term of this patent is extended or adjusted under 35 U.S.C. 154(b) by 0 days.

(21) Appl. No.: 12/718,517

(22) Filed: Mar. 5, 2010

(65) Prior Publication Data

US 2011/0218060 A1 Sep. 8, 2011

(51) Int. Cl.
*A63B 59/02* (2006.01)
*A63B 69/12* (2006.01)

(52) U.S. Cl. ..... 473/513; D21/724

(58) Field of Classification Search ..... 473/505, 473/513, 512; D21/724
See application file for complete search history.

(56) References Cited

U.S. PATENT DOCUMENTS

| | | | | |
|---|---|---|---|---|
| 1,459,389 | A | 6/1923 | Brown | |
| 2,205,706 | A * | 6/1940 | Wolff | 210/495 |
| 2,710,753 | A | 6/1955 | Lockwwod | |
| 3,473,806 | A | 10/1969 | Patterson | |
| 3,507,495 | A | 4/1970 | Tucker et al. | |
| 3,591,178 | A | 7/1971 | Milligan | |
| 3,702,702 | A | 11/1972 | Hoult | |
| 3,822,062 | A | 7/1974 | Tucker et al. | |
| 3,905,088 | A | 9/1975 | Tucker et al. | |
| 3,910,578 | A | 10/1975 | Brine, Jr. | |
| 4,022,477 | A | 5/1977 | Pool | |
| 4,034,984 | A | 7/1977 | Crawford et al. | |
| 4,037,841 | A | 7/1977 | Lewis, Jr. | |
| 4,049,273 | A | 9/1977 | Pool | |
| 4,097,046 | A | 6/1978 | Friant | |
| D248,679 | S | 7/1978 | Rule | |
| 4,138,111 | A | 2/1979 | Rule | |
| 4,153,251 | A | 5/1979 | Pond | |
| D252,167 | S | 6/1979 | Ahlenfeld et al. | |
| 4,206,918 | A | 6/1980 | Lewis, Jr. | |
| 4,270,756 | A | 6/1981 | Ahlenfeld et al. | |
| D263,249 | S | 3/1982 | Rule | |
| D265,845 | S | 8/1982 | Brine, Jr. et al. | |
| 4,351,528 | A | 9/1982 | Duplin | |
| 4,358,117 | A * | 11/1982 | Deutsch | 473/513 |
| 4,399,992 | A | 8/1983 | Molitor | |
| D273,601 | S | 4/1984 | Lewis, Jr. et al. | |
| D286,666 | S | 11/1986 | Brine, Jr. | |
| D286,803 | S | 11/1986 | Brine, Jr. | |
| 4,657,260 | A | 4/1987 | Brine, Jr. | |

(Continued)

OTHER PUBLICATIONS

U.S. Appl. No. 29/380,249, Vestuti et al., "Lacrosse Stick", filed Dec. 2, 2010.

*Primary Examiner* — Gene Kim
*Assistant Examiner* — M Chambers
(74) *Attorney, Agent, or Firm* — Sterne Kessler Goldstein & Fox P.L.L.C.

(57) ABSTRACT

A lacrosse head is disclosed, comprising: a frame having a base, a pair of sidewalls extending from the base, and a scoop connecting the pair of sidewalls opposite the base, the scoop defining an aperture for receiving a portion of a net, wherein the aperture has an upper edge and a lower edge, the lower edge having a first notch, a second notch, and a center portion intermediate to the first notch and the second notch. Also disclosed is a lacrosse stick comprising: an elongated shaft having a butt end and a head end, and a port formed through the head end; and a head attachable to the shaft.

17 Claims, 16 Drawing Sheets

U.S. PATENT DOCUMENTS 4,739,994 A 4/1988 Lewis, Jr.
D297,963 S 10/1988 Tucker et al.
4,861,042 A 8/1989 Trettin
5,007,652 A * 4/1991 Tucker et al. ..... 473/513
5,037,112 A 8/1991 Brine, III et al.
5,048,843 A 9/1991 Dorfi et al.
5,054,790 A 10/1991 Brine, III et al.
5,067,726 A 11/1991 Brine, III et al.
5,080,372 A 1/1992 Brine, III et al.
5,082,290 A 1/1992 Tucker et al.
D331,086 S 11/1992 Brine, III et al.
5,178,397 A 1/1993 Brine, Jr.
5,269,532 A 12/1993 Tucker et al.
D350,173 S 8/1994 Tucker et al.
D350,174 S 8/1994 Tucker et al.
5,373,616 A 12/1994 Biersdorf et al.
5,405,132 A * 4/1995 St. Onge ..... 473/489
5,478,647 A 12/1995 Miyamoto et al.
5,494,297 A 2/1996 MacNeil
5,566,947 A 10/1996 Tucker et al.
5,568,925 A 10/1996 Morrow et al.
D376,183 S 12/1996 Morrow et al.
5,651,549 A 7/1997 Dill et al.
5,651,744 A 7/1997 Millon et al.
5,674,140 A 10/1997 Tucker et al.
5,685,791 A 11/1997 Feeney
5,715,539 A 2/1998 Benecki et al.
5,935,026 A 8/1999 Dill et al.
5,938,550 A 8/1999 Hexemer et al.
5,957,791 A 9/1999 Nichols et al.
5,967,912 A 10/1999 Hexemer et al.
6,066,056 A 5/2000 Morrow
6,098,199 A 8/2000 Barkin
6,186,912 B1 2/2001 Gait
6,213,901 B1 4/2001 Collinson
D444,834 S 7/2001 Tucker, Sr.
D445,472 S 7/2001 Tucker, Sr.
6,283,879 B1 9/2001 Eden et al.
6,305,051 B1 10/2001 Cho
6,447,410 B2 9/2002 Crawford
RE37,894 E 10/2002 MacNeil
6,500,079 B1 12/2002 Tucker, Sr.
6,506,132 B1 1/2003 Brine, III et al.
6,511,386 B1 1/2003 Cacicedo
6,520,875 B1 2/2003 Crawford
6,533,686 B2 3/2003 LeMire
6,561,932 B2 5/2003 Morrow et al.
RE38,216 E 8/2003 Morrow et al.
6,641,492 B2 11/2003 LeMire
6,676,547 B1 * 1/2004 Morrow et al. ..... 473/513
6,723,134 B2 4/2004 Tucker, Sr.
6,752,730 B1 6/2004 Brine, Jr. et al.
6,755,757 B2 6/2004 Sutherland
D496,083 S 9/2004 Kohler
6,852,047 B2 2/2005 Tucker, Sr.
6,872,157 B2 3/2005 Falone et al.
6,902,501 B2 6/2005 Morrow et al.
6,910,976 B2 6/2005 Tucker, Sr.
6,916,035 B2 7/2005 Houser et al.
6,916,259 B2 7/2005 Kohler et al.
6,921,347 B1 7/2005 Morrow et al.
6,923,739 B2 8/2005 Gait et al.
6,926,628 B2 8/2005 Morrow et al.
6,929,572 B2 8/2005 Morrow et al.
6,949,037 B2 9/2005 Enos et al.
6,960,144 B2 11/2005 Tucker, Sr.
6,962,541 B2 11/2005 Mitzak
6,966,854 B1 11/2005 Gait
6,994,640 B2 2/2006 Morrow et al.
7,008,339 B2 3/2006 Sutherland
7,022,035 B2 4/2006 Morrow et al.
7,044,868 B2 5/2006 Brine et al.
7,070,523 B1 7/2006 Gait
7,094,167 B2 8/2006 Tucker, Sr.
7,101,294 B2 * 9/2006 Tucker, Sr. ..... 473/513
7,104,904 B1 9/2006 Gait
7,108,616 B2 9/2006 Morrow et al.
7,131,919 B2 11/2006 Kohler et al.
7,150,691 B2 12/2006 Gait et al.
7,192,369 B2 3/2007 Morrow
7,338,396 B2 3/2008 Gait
7,344,460 B2 * 3/2008 Gait ..... 473/513
7,736,251 B2 6/2010 Rogers et al.
7,766,772 B2 8/2010 Morrow et al.
D629,855 S 12/2010 Vestuti et al.
2002/0091013 A1 7/2002 Bayne
2004/0116217 A1 6/2004 Morrow et al.
2005/0043123 A1 2/2005 Harvey
2006/0264277 A1 * 11/2006 Tucker et al. ..... 473/513
2007/0072708 A1 * 3/2007 Reeb ..... 473/513
2008/0039243 A1 * 2/2008 Morrow et al. ..... 473/513
2011/0218060 A1 * 9/2011 Vestuti et al. ..... 473/513

* cited by examiner

LACROSSE HEAD AND STICK

BACKGROUND OF THE INVENTION

1. Field of the Invention

The present invention is directed to a lacrosse head and stick.

2. Background Art

Lacrosse heads typically include a frame with a series of openings along the scoop and sidewalls of the frame for securing a net thereto. The size and shape of these openings may affect a user's ability to string the net onto the lacrosse head. Some openings on conventional lacrosse heads are small or awkwardly shaped so as to make stringing of the lacrosse net more difficult. In addition, the size and shape of these openings may affect the performance of the lacrosse stick. For example, the size and/or shape of these openings may affect the stiffness, flexibility, and/or aerodynamic response of the lacrosse head during play. Accordingly, a need exists for lacrosse heads and lacrosse sticks incorporating lacrosse heads that provide for improved openings along the scoop and sidewalls of the frame for securing a net thereto.

BRIEF SUMMARY OF THE INVENTION

Embodiments of the present invention relate to a lacrosse head, comprising: a frame having a base, a pair of sidewalls extending from the base, and a scoop connecting the pair of sidewalls opposite the base, the scoop defining an aperture for receiving a portion of a net, an inner scoop surface, and an outer scoop surface. The aperture includes an upper edge and a lower edge, the lower edge having a first notch, a second notch, and a center portion intermediate to the first notch and the second notch.

Embodiments of the present invention further relate to a lacrosse head having a base portion; a pair of sidewalls extending from the base portion; a scoop connecting the pair of sidewalls opposite the base portion, the scoop having an inner surface and an outer surface; and a plurality of apertures formed in the scoop, each of the plurality of apertures having rounded first and second end portions and a center portion intermediate the end portions. The apertures have a void area and the total void area of the plurality of apertures comprises at least about 30% of the total area of the scoop.

Embodiments of the present invention further relate to a lacrosse head, comprising: an apertured portion, wherein the apertured portion defines an aperture for receiving a portion of a net, the aperture having an upper edge and a lower edge, the lower edge having a first notch, a second notch, and a center portion intermediate to the first notch and the second notch. The apertured portion may be disposed in a scoop or sidewall portion of the head.

Embodiments of the present invention may also relate to a lacrosse stick, comprising: an elongated shaft having a butt end and a head end, and a port formed through the head end; and a head attachable to the shaft. The head may comprise: a base portion, a pair of sidewalls extending forwardly from the base portion, a scoop connecting the pair of sidewalls opposite the base portion, and a throat portion extending from the base portion for axially receiving the head end of the shaft, the throat portion having a front portion and a back portion, wherein the front portion defines a front aperture and the back portion defines a back aperture, and an opening. When the head is joined to the shaft, the port formed in the head end of the shaft is aligned with both the front aperture and the back aperture such that a void extends through the head and the shaft.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
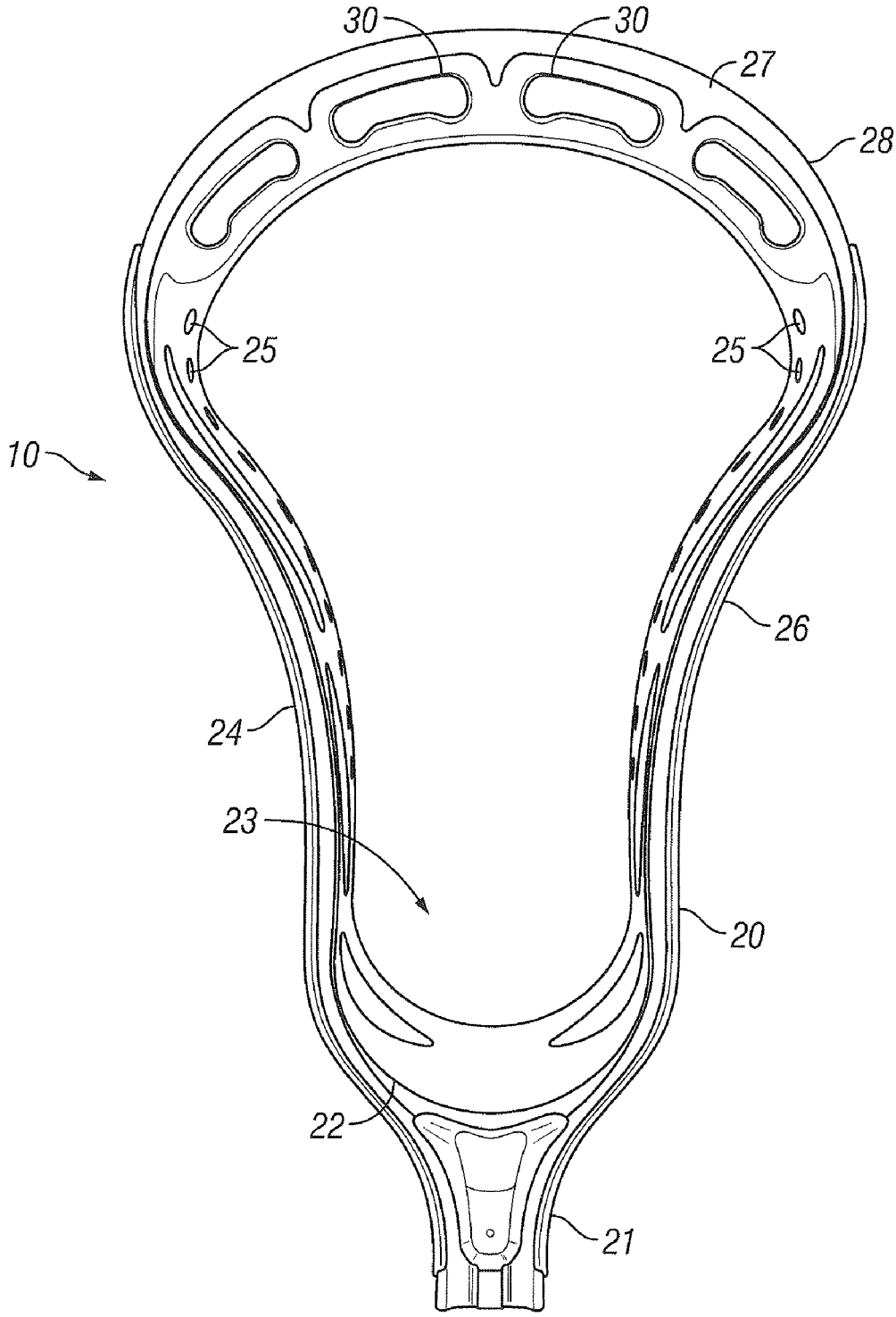
FIG. 1 is a top view of a lacrosse head according to an embodiment of the present invention.

The present invention will now be described in detail with reference to embodiments thereof as illustrated in the accompanying drawings, in which like reference numerals are used to indicate identical or functionally similar elements. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present invention. Other suitable modifications and adaptations of the variety of conditions and parameters normally encountered in the field, and which would be apparent to those skilled in the art, are within the spirit and scope of the invention.

Figure 4:
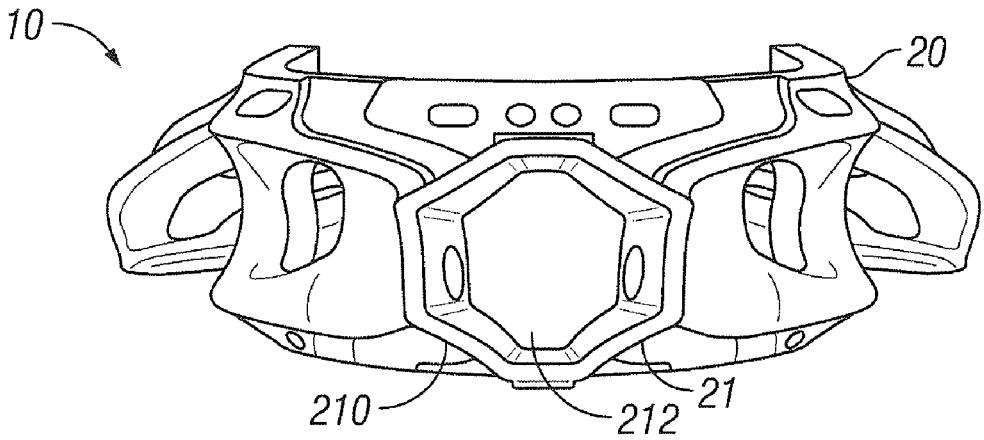
FIG. 4 is a rear view of a lacrosse head according to an embodiment of the present invention.

With reference to FIGS. 1-4, embodiments of the present invention include a head 10 for a lacrosse stick. The head 10 comprises a frame 20 having a base 22 and a pair of sidewalls 24 and 26 extending from the base 22. The base 22 and the lower portion of the sidewalls 24 and 26 form a ball stop area 23 to provide for retaining a lacrosse ball during play. At the end of the frame opposite the base 22, the sidewalls 24 and 26 are connected by a scoop 28 having an inner face 27 and an outer face 29. In one embodiment, the scoop 28 is curved to permit retrieving the lacrosse ball off the ground and releasing the ball from the head 10. As shown in FIG. 4, a throat 21 projects from the base 22 and includes a socket 210 which defines an opening 212 for axially receiving an end of a lacrosse shaft 50 (FIGS. 29-32), as discussed in detail below.

As shown, for example, in FIG. 1, the sidewalls 24 and 26 diverge generally outwardly from the base 22. In one embodiment, the sidewalls 24 and 26 may diverge from the base 22 gradually so as to form an hourglass-shaped frame 20. In other embodiments, the sidewalls 24 and 26 may diverge from the base 22 to form any desired shape for the frame 20. For example, in one embodiment, the sidewalls 24 and 26 may be generally straight as they diverge from the base 22 such that the frame 20 may form a v-shape. As will be appreciated by those of skill in the art, other suitable shapes for the frame 20, generally, and the sidewalls 24 and 26, and the scoop 28, in particular, may be used.

In one embodiment, the head 10 comprises injection molded plastic, such as, for example, nylon or nylon composite. In addition to, or instead of, nylon or nylon composite, other suitable materials, including, but not limited to, other plastic, other thermoplastic such as, for example, thermoplastic polyurethane (TPU), thermoplastic elastomer (TPE), or thermoplastic copolyester elastomer (TPC), composite (e.g., glass, carbon, or kevlar fiber-containing composite), wood, metal such as, for example, titanium or stainless steel, and combinations thereof may be used. In alternative embodiments, the head 10 may be made from multiple materials. For example, in one embodiment, at least a portion of the sidewalls 24 and/or 26, and/or the scoop 28 may be overmolded with a suitable material, such as, for example, nylon, other plastic, other thermoplastic such as, for example, thermoplastic polyurethane (TPU), thermoplastic elastomer (TPE), or thermoplastic copolyester elastomer (TPC), composite (e.g., glass, carbon, or kevlar fiber-containing composite), wood, metal such as, for example, titanium or stainless steel, and combinations thereof. In one embodiment, the material comprising the overmolded portion of the head 10 may have different properties than the material comprising the non-overmolded portion of the head 10. For example, the overmolded portion of the head 10 may be more or less stiff than the non-overmolded portion. In one embodiment, the head 10 is a unitary structure that is injection molded using known techniques.

Figure 5:
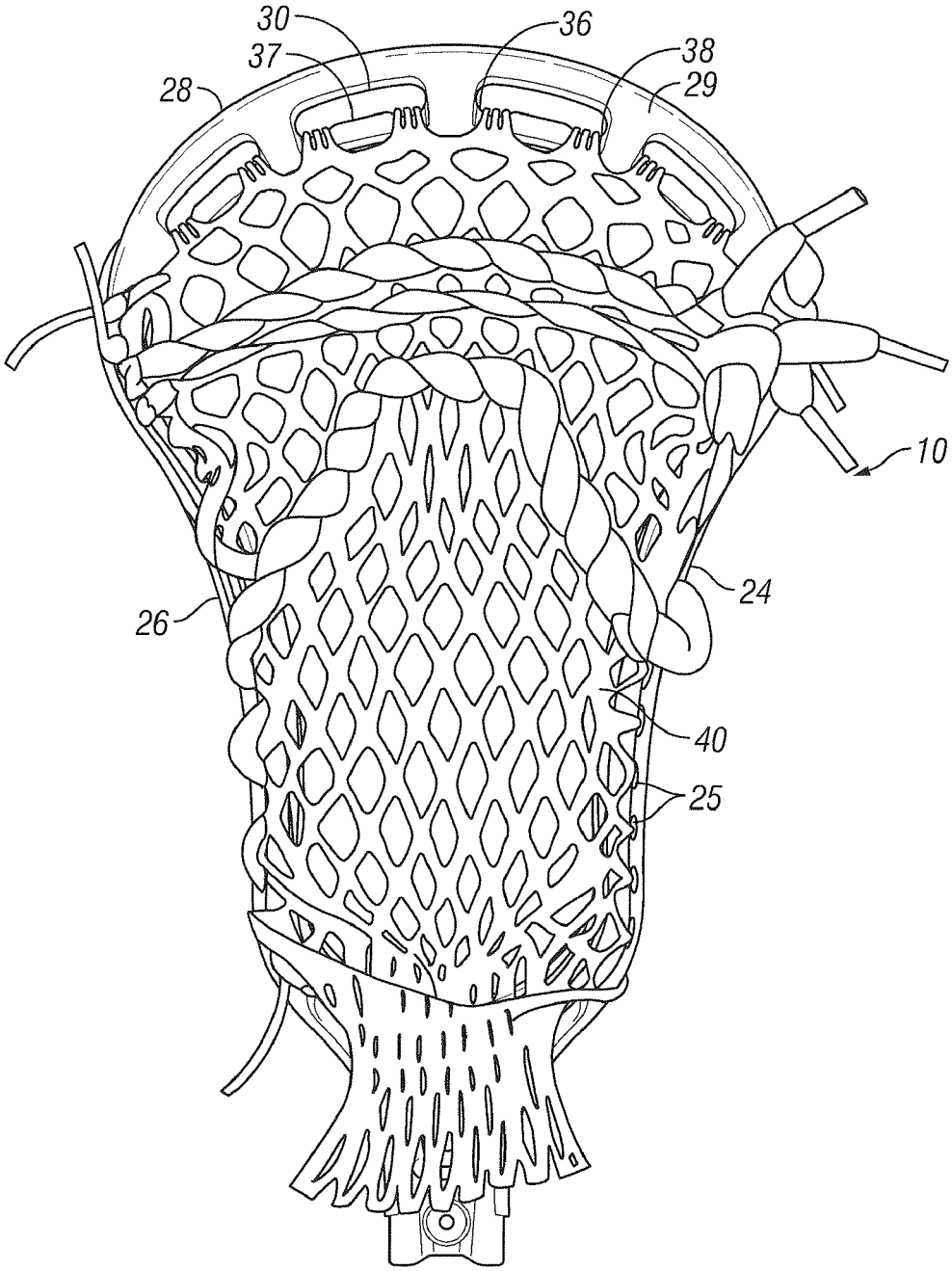
FIG. 5 is a rear view of a lacrosse head with a net according to an embodiment of the present invention.
Figure 6:
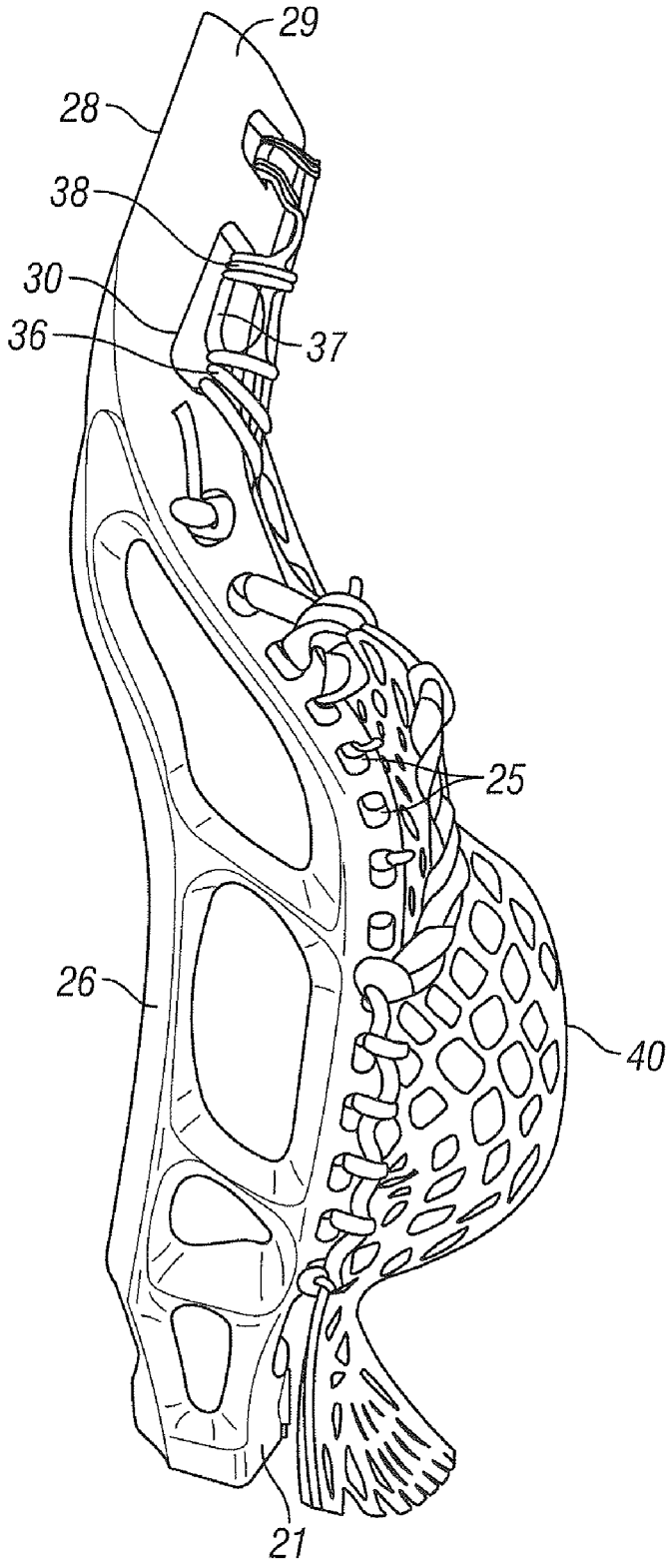
FIG. 6 is a side view of a lacrosse head with a net according to an embodiment of the present invention.

A plurality of apertures 25 is formed through each of the sidewalls 24 and 26 and a plurality of apertures 30 is formed through the scoop 28 to provide for securing a lacrosse net 40 (as shown, for example, in FIGS. 5 and 6) to the frame 20. The net 40 is adapted for receiving and carrying the lacrosse ball within the frame 20. In one embodiment, the net 40 may be strung on the head 10 in the configuration shown, for example, in FIGS. 5 and 6. It is appreciated that the net 40 may be strung through the apertures 25 and 30 in any suitable configuration to provide the desired functional and/or aesthetic features of the lacrosse head 10. The net may comprise leather, nylon, cotton, polyester, and/or other suitable material. The apertures 30 formed through the scoop 28 generally may be larger than the sidewall apertures 25 and in one embodiment may be adapted to facilitate stringing of the lacrosse net, as will be discussed in more detail below.

Figure 7:
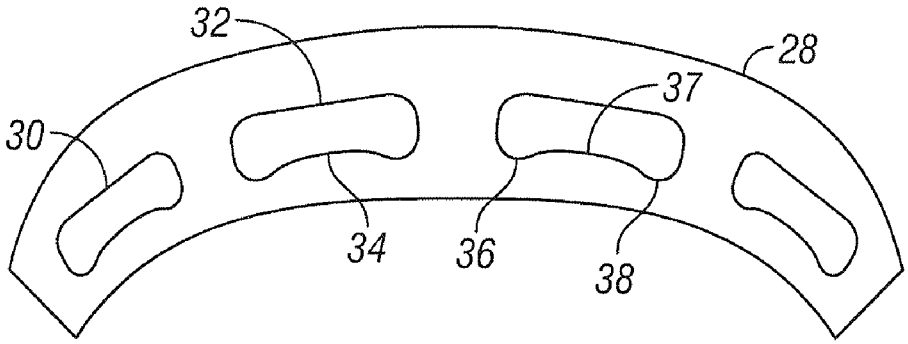
FIG. 7 is a perspective view of a scoop portion of a lacrosse head having a plurality of net receiving apertures according to a first embodiment of the present invention.
Figure 8:
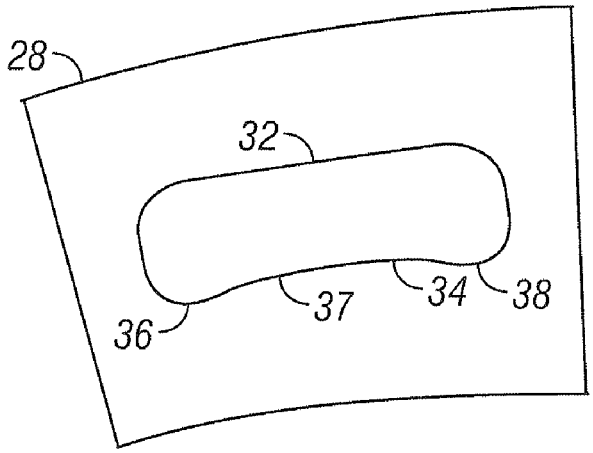
FIG. 8 is an enlarged perspective view of a net receiving aperture shown in FIG. 7 according to an embodiment of the present invention.

With reference to FIGS. 7 and 8, one or more apertures 30 may be defined at least in part by an upper edge 32 and a lower edge 34. In one embodiment, the lower edge 34 may define a first notch 36, a second notch 38, and a center portion 37 disposed intermediate the first notch 36 and the second notch 38. In one embodiment, one or both of the first notch 36 and the second notch 38 may be rounded, and the center portion 37 may be substantially flat. When the net is strung through the aperture 30, as shown, for example, in FIGS. 5 and 6, the first notch 36 and the second notch 38 are adapted to receive a portion of the lacrosse net. In this manner, the lower edge 34 may define one or more net-receiving portions that may facilitate stringing of the lacrosse net on the lacrosse head 10. In addition, the first notch 36 and the second notch 38 may allow for proper positioning of the lacrosse net during use of the lacrosse head 10. In one embodiment, the upper edge 32 of the aperture 30 may be substantially flat and may be substantially parallel to the center portion 37 of the lower edge 34. The exact size and shape of the apertures 30 shown in FIGS. 7 and 8 are intended to be exemplary only. As shown in FIGS. 10-26 and discussed in more detail below, other shapes, configurations, and combinations of apertures 30 may be used.

In one embodiment, one or both of the first notch 36 and the second notch 38 may extend below the center portion 37 of the lower edge 34. The center portion 37 may separate the first notch 36 and the second notch 37, and, accordingly, may keep adjacent strings of the lacrosse net separated during stringing of the lacrosse net 10 and during play. In this manner, the center portion 37 may define a net-separating portion that may allow for proper positioning of the lacrosse net during use of the lacrosse head 10 and may facilitate stringing of the lacrosse net.

Figure 9:
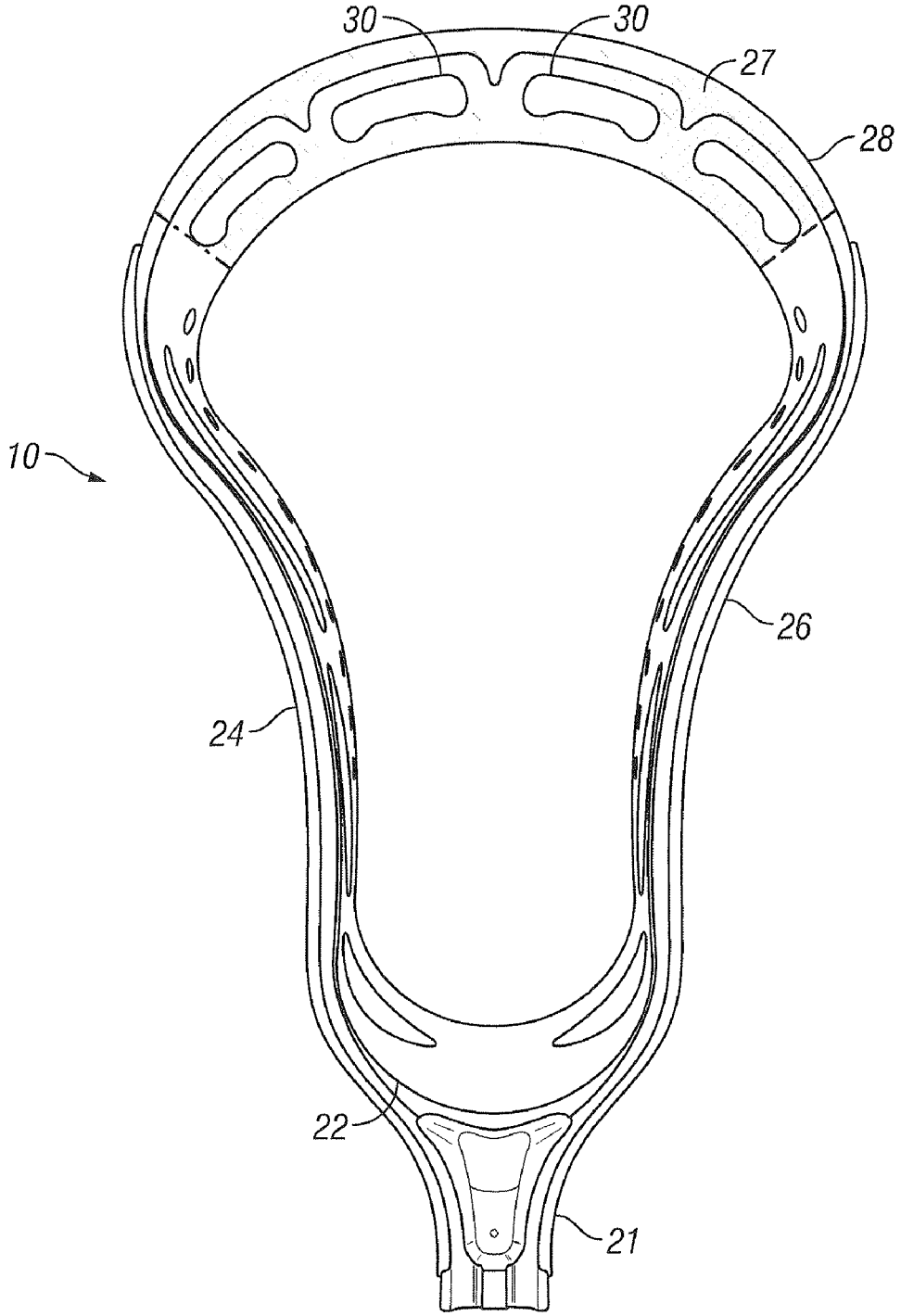
FIG. 9 is a perspective view of a lacrosse head with a shaded scoop portion according to an embodiment of the present invention.

In one embodiment of the present invention, one or more of the apertures 30 are oversized as compared to conventional lacrosse head apertures (such as, for example, sidewall apertures 25). The relative size of the plurality of apertures 30 may be defined as a percentage of the total area of the scoop 28 if the apertures were otherwise filled. In one embodiment, the total area of the scoop 28 may be defined as the area between the left side of the left-most aperture 30 and the right side of the right-most aperture 30, as illustrated, for example, by the area bounded by the vertical dotted lines shown in FIG. 9 (including the area if the apertures were otherwise filled).

In one embodiment, the plurality of apertures 30 formed in the scoop 28 comprises at least about 30% of the total area of the scoop 28. For example, the total area of the scoop 28 may be approximately 6186 $mm^2$ and the total void area of the plurality of apertures 30 may be approximately 1817 $mm^2$. In another embodiment, the plurality of apertures 30 formed in the scoop 28 comprises at least about 40% of the total area of the scoop 28. In yet another embodiment, the plurality of apertures 30 formed in the scoop 28 comprises at least about 50% of the total area of the scoop 28. In another embodiment, the plurality of apertures 30 formed in the scoop 28 may comprise a percentage in the range of from about 30% to about 50% of the total area of the scoop 28.

In one embodiment, the apertures 30 may be oversized so as to facilitate stringing of the lacrosse net 40. Conventional lacrosse head apertures may be typically sized such that they have an area that is only about at most twice the cross-sectional area of the net's string, which may be about 3-4 mm in diameter. This may lead to difficulty in stringing the net through the aperture, particularly when the end of the string may be frayed or worn. In one embodiment, one or more apertures 30 may have an area more than about four (4) times the cross-sectional area of the string. In one embodiment, each of one or more apertures 30 may have an area more than about five (5) times the cross-sectional area of the string.

In one embodiment, because the apertures 30 may provide for less material in the scoop 28 and provide for a greater area of open holes, the size of the apertures 30 may further provide for improved aerodynamics of the head 10. In one embodiment, one or more apertures 30 may be sized to provide the desired aerodynamics effects of the head 10. For example, the apertures 30 may be sized such that less air resistance is imparted upon the head 10 during use. In addition, one or more apertures 30 may be sized to provide the desired weight of the head 10.

In one embodiment, one or more apertures 30 may be configured to provide the desired stiffness of the head 10. The stiffness of a head may be tested in two orientations: lateral (side to side) and vertical (top to bottom). In one embodiment, a general procedure for testing the lateral flex and vertical flex of the head 10 having one or more apertures 30 is as follows. For lateral flex testing, the head is placed directly on a fixture plate (sidewall facing down). The head is impacted with an impact head for five (5) cycles and displaced 50 mm (in the direction of sidewall toward sidewall) to generate forces that may be representative of a lacrosse head during use. An average stiffness can be calculated by averaging data collected from impacts, such as impacts 1, 3, and 5. In some embodiments, the lacrosse head 10 having one or more apertures 30 has an average lateral stiffness of less than about 5 N/mm or less than about 4 N/mm. In other embodiments, the lacrosse head 10 having one or more apertures 30 has an average lateral stiffness of at least about 3.5 N/mm. Thus, in some embodiments, the lacrosse head has an average lateral stiffness of about 3.5 to about 5 N/mm, about 3.5 to about 4 N/mm, or about 3.9 N/mm.

For vertical flex testing, the head is oriented vertically such that the scoop contacts a fixture plate. The head is impacted for five (5) cycles and displaced 40 mm (in the direction of throat toward scoop) to generate forces that may be representative of a lacrosse head during use. An average stiffness can be calculated by averaging data collected from impacts, such as impacts 1, 3, and 5. In some embodiments, the lacrosse head 10 having one or more apertures 30 has an average vertical stiffness of at least about 10 N/mm, at least about 13 N/mm, or at least about 15 N/mm. For example, in some embodiments, the lacrosse head 10 having one or more apertures 30 has an average vertical stiffness of about 10 to about 20, about 13 to about 18, about 14 to about 16, or about 15.5 N/mm. In some embodiments, the lacrosse head 10 having one or more apertures 30 has an average lateral stiffness of about 3.5 to about 4 N/mm and an average vertical stiffness of at least about 13 N/mm.

In one embodiment, one or more apertures 30 may be configured to provide the desired stiffness for head 10 for different game playing positions. For example, the apertures may be configured to provide a stiffer head 10 for one position (e.g., defense) or to provide a less stiff head 10 for another position (e.g., attack). The apertures 30 may also be configured to provide a more or less compliant scoop 28, which may, for example, effect ball control or a player's ability to pick the ball off of the ground.

Figure 10:
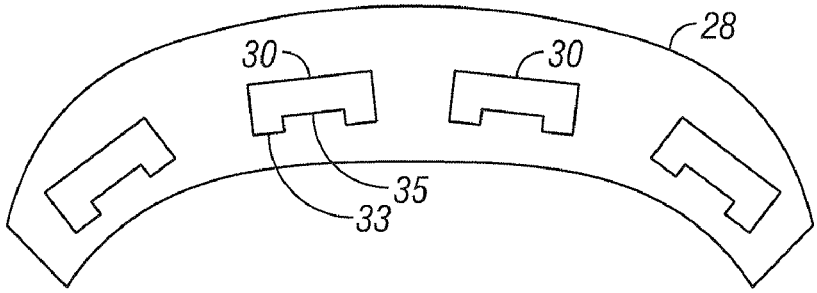
FIG. 10 is a perspective view of a scoop portion of a lacrosse head having a plurality of net receiving apertures according to a second embodiment of the present invention.

With reference to FIGS. 10-26, other shapes, configurations, and combinations of apertures 30 may be used. In these embodiments, the apertures 30 may include one or more net receiving portions 33 (e.g., a notch) and one or more net separating portions 35 (e.g., a portion disposed between two net receiving portions). As shown in FIG. 10, in one embodiment one or more apertures 30 may include first and second square-shaped notches 33 separated by a substantially flat center portion 35.

Figure 11:
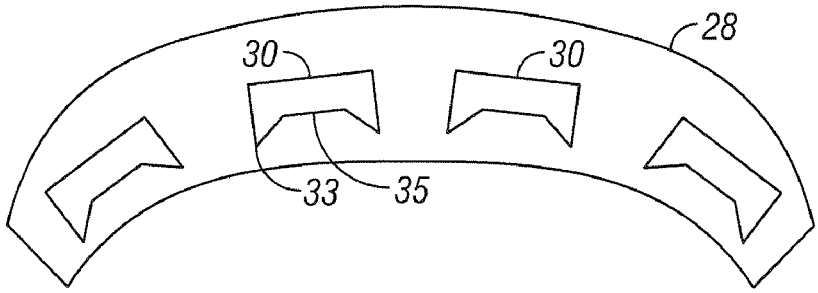
FIG. 11 is a perspective view of a scoop portion of a lacrosse head having a plurality of net receiving apertures according to a third embodiment of the present invention.

As shown in FIG. 11, in one embodiment one or more apertures 30 may include first and second pointed notches 33 separated by a substantially flat center portion 35.

Figure 12:
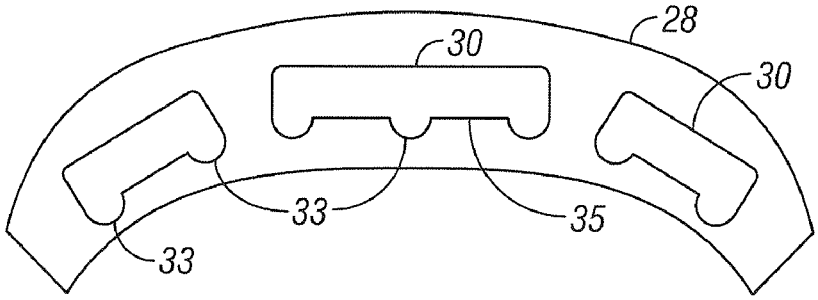
FIG. 12 is a perspective view of a scoop portion of a lacrosse head having a plurality of net receiving apertures according to a fourth embodiment of the present invention.
Figure 13:
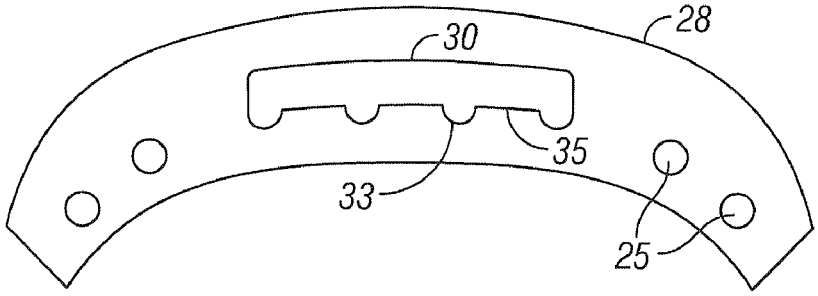
FIG. 13 is a perspective view of a scoop portion of a lacrosse head having a plurality of net receiving apertures according to a fifth embodiment of the present invention.

As shown in FIGS. 12 and 13, in one embodiment, one or more apertures 30 may include three or more notches 33. In addition, the scoop 28 may include apertures having a different number of notches 33. For example, as shown in FIG. 12, in one embodiment one or more apertures may include three notches 33, and one or more apertures 30 may include two notches 33. Such combinations may provide the head 10 with a variety of stringing options in a single head.

Figure 22:
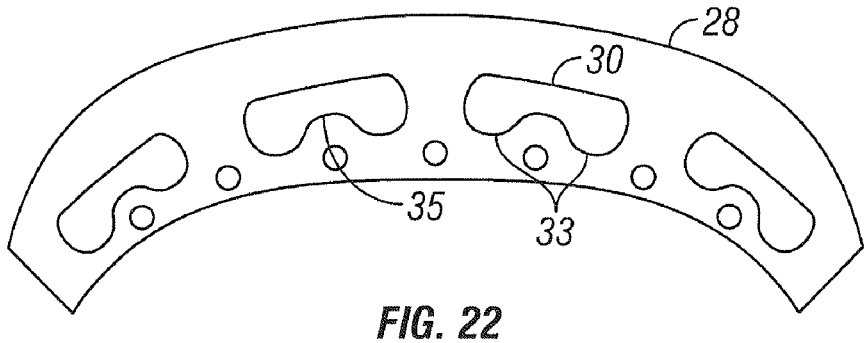
FIG. 22 is a perspective view of a scoop portion of a lacrosse head having a plurality of net receiving apertures according to a fourteenth embodiment of the present invention.
Figure 23:
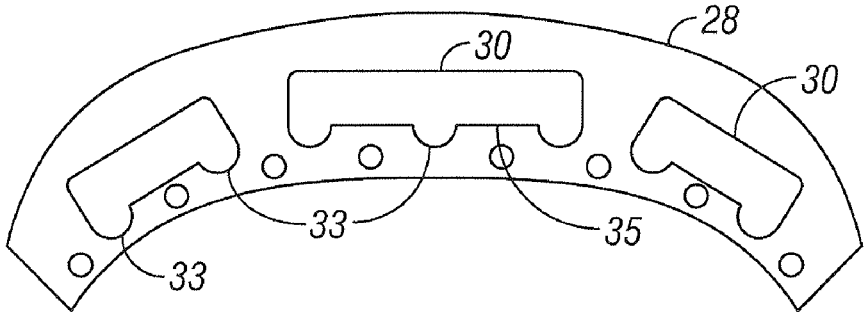
FIG. 23 is a perspective view of a scoop portion of a lacrosse head having a plurality of net receiving apertures according to a fifteenth embodiment of the present invention.
Figure 24:
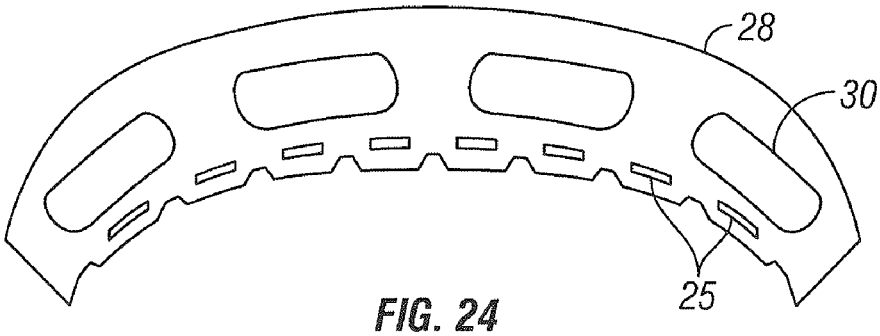
FIG. 24 is a perspective view of a scoop portion of a lacrosse head having a plurality of net receiving apertures according to a sixteenth embodiment of the present invention.
Figure 25:
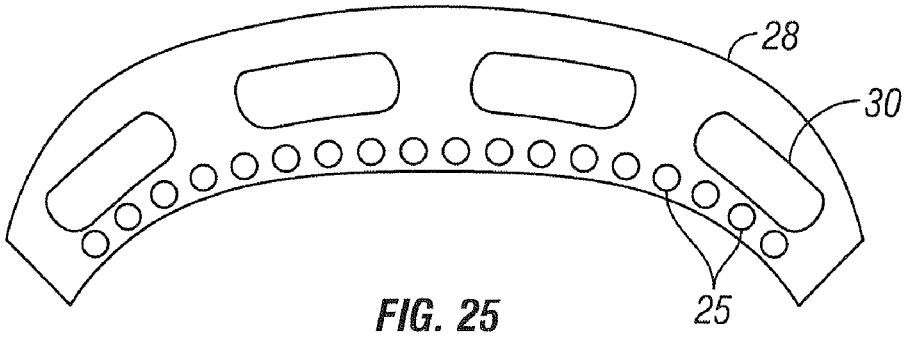
FIG. 25 is a perspective view of a scoop portion of a lacrosse head having a plurality of net receiving apertures according to a seventeenth embodiment of the present invention.

In some embodiments, the scoop 28 may include one or more oversized apertures 30 and one or more conventional apertures 25. For example, as shown in FIG. 13, the scoop 28 may include a plurality of conventional apertures 25 and a centrally located oversized aperture 30 having one or more notches 33. As shown in FIGS. 22 and 23, the scoop 30 may include a plurality of oversized apertures 30 and a plurality of conventional apertures 25. For example, the plurality of conventional apertures 25 may be disposed generally below the oversized apertures 30. As shown in FIGS. 24 and 25, one or more oversized apertures 30 may include no notches. The combination of oversized apertures 30 and conventional apertures 25 may provide for conventional stringing with apertures 25 and desired aerodynamic and/or stiffness properties with the oversized apertures 30 in the same head 10. Such combinations may also provide the head 10 with a variety of stringing options in a single head.

Figure 14:
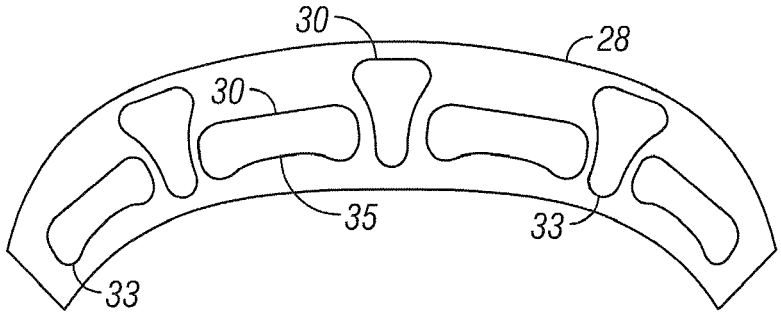
FIG. 14 is a perspective view of a scoop portion of a lacrosse head having a plurality of net receiving apertures according to a sixth embodiment of the present invention.

As shown in FIG. 14, in one embodiment one or more apertures 30 may include only one notch 33 and may not include a net separating portion 35.

Figure 15:
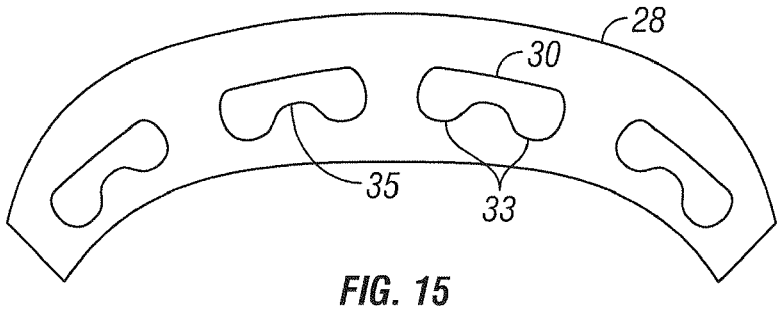
FIG. 15 is a perspective view of a scoop portion of a lacrosse head having a plurality of net receiving apertures according to a seventh embodiment of the present invention.
Figure 16:
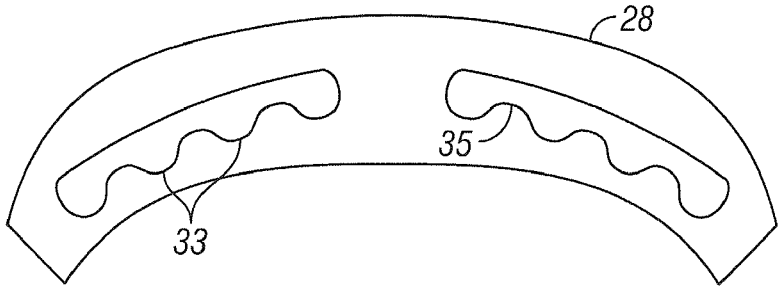
FIG. 16 is a perspective view of a scoop portion of a lacrosse head having a plurality of net receiving apertures according to a eighth embodiment of the present invention.

As shown in FIGS. 15 and 16, in some embodiments, one or more apertures 30 may include a rounded net separating portion 35.

Figure 17:
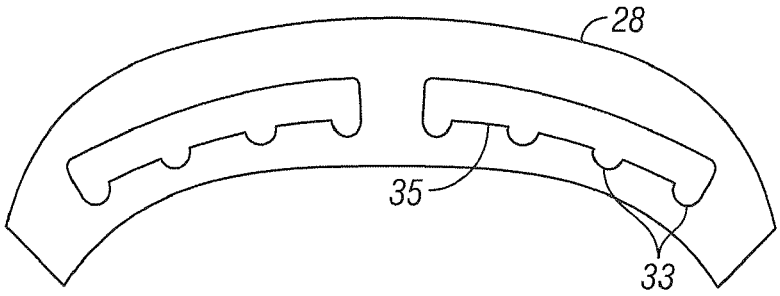
FIG. 17 is a perspective view of a scoop portion of a lacrosse head having a plurality of net receiving apertures according to a ninth embodiment of the present invention.

As shown in FIGS. 16 and 17, in some embodiments, the scoop 28 may include only two oversized notches. In one embodiment, two or more apertures 30 may include four or more notches 33.

Figure 18:
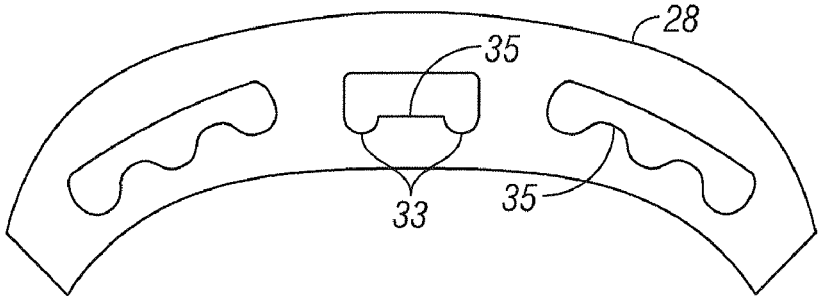
FIG. 18 is a perspective view of a scoop portion of a lacrosse head having a plurality of net receiving apertures according to a tenth embodiment of the present invention.

As shown in FIG. 18, in one embodiment, one or more apertures 30 may include a substantially flat net separating portion 35 and one or more apertures 30 may include a rounded net separating portion 35.

Figure 19:
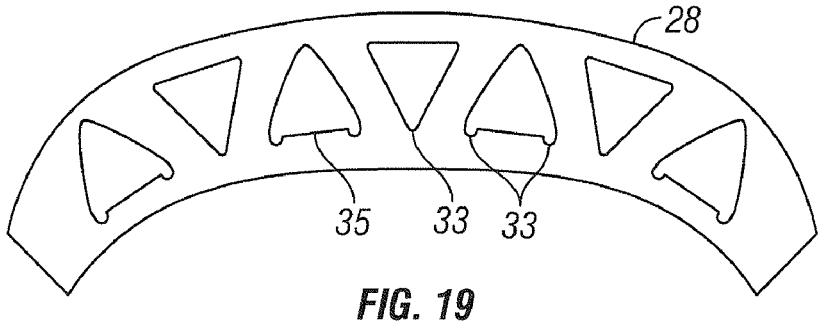
FIG. 19 is a perspective view of a scoop portion of a lacrosse head having a plurality of net receiving apertures according to a eleventh embodiment of the present invention.

As shown in FIG. 19, in one embodiment, one or more apertures 30 may comprise a generally triangular shape. The triangular shaped apertures 30 may be oriented such that the apex is pointed down so as to provide one notch 33 or may be oriented such that the apex is pointed up so as to provide two notches 33 along the base of the triangle. In one embodiment, adjacent apertures 30 may alternate such that a first aperture is oriented such that the apex is pointed down and a second aperture is oriented such that the apex is pointed up.

Figure 20:
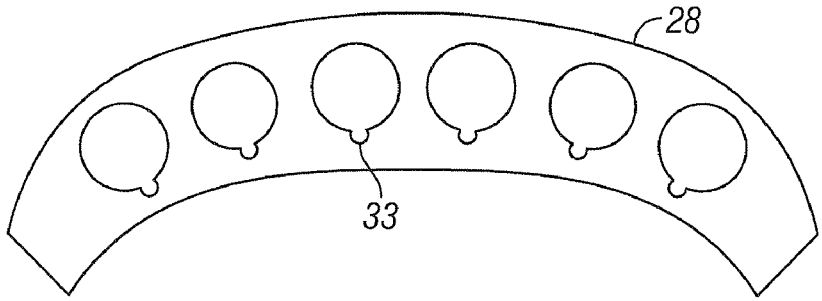
FIG. 20 is a perspective view of a scoop portion of a lacrosse head having a plurality of net receiving apertures according to a twelfth embodiment of the present invention.

As shown in FIG. 20, in one embodiment, one or more apertures 30 may comprise a generally circular shape with one notch 33.

Figure 21:
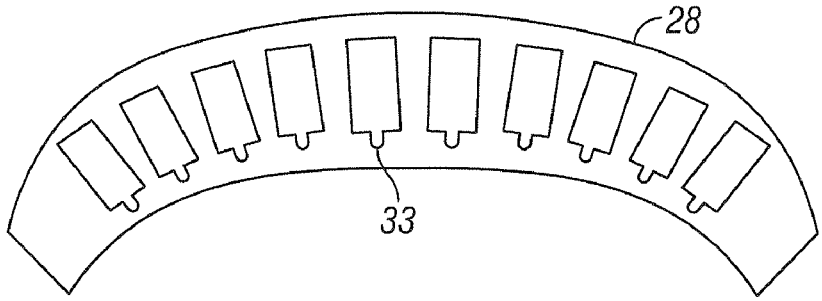
FIG. 21 is a perspective view of a scoop portion of a lacrosse head having a plurality of net receiving apertures according to a thirteenth embodiment of the present invention.

As shown in FIG. 21, in one embodiment, one or more apertures 30 may comprise a generally rectangular shape with one notch 33.

Figure 26:
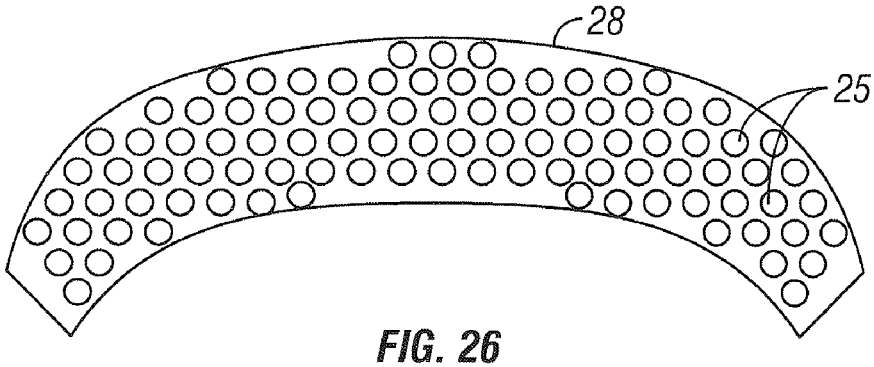
FIG. 26 is a perspective view of a scoop portion of a lacrosse head having a plurality of net receiving apertures according to a eighteenth embodiment of the present invention.

As shown in FIG. 26, in one embodiment, the scoop 28 may include a plurality of apertures 25 such that the apertures substantially cover the total area of the scoop 28. Because the apertures may provide for less material in the scoop 28 and provide for a greater area of open holes, the number of apertures 25 may further provide the desired aerodynamics and/or stiffness properties of the head 10. The number of apertures 25 may also provide the head 10 with a variety of stringing options in a single head. In some embodiments, the plurality of apertures 25 formed in the scoop 28 comprises at least about 30%, at least about 40%, or at least about 50% of the total area of the scoop 28. In one embodiment, the plurality of apertures 25 formed in the scoop 28 may comprise a percentage in the range of from about 30% to about 50% of the total area of the scoop 28.

The shapes, configurations, and combinations of apertures 30 shown in FIGS. 10-26 are intended to be exemplary only. Any of the features shown may be used alone or in other combinations with one or more features from other embodiments. In one embodiment, one or more of the apertures 30 may be disposed through the sidewalls 24 and/or 26.

Figure 2:
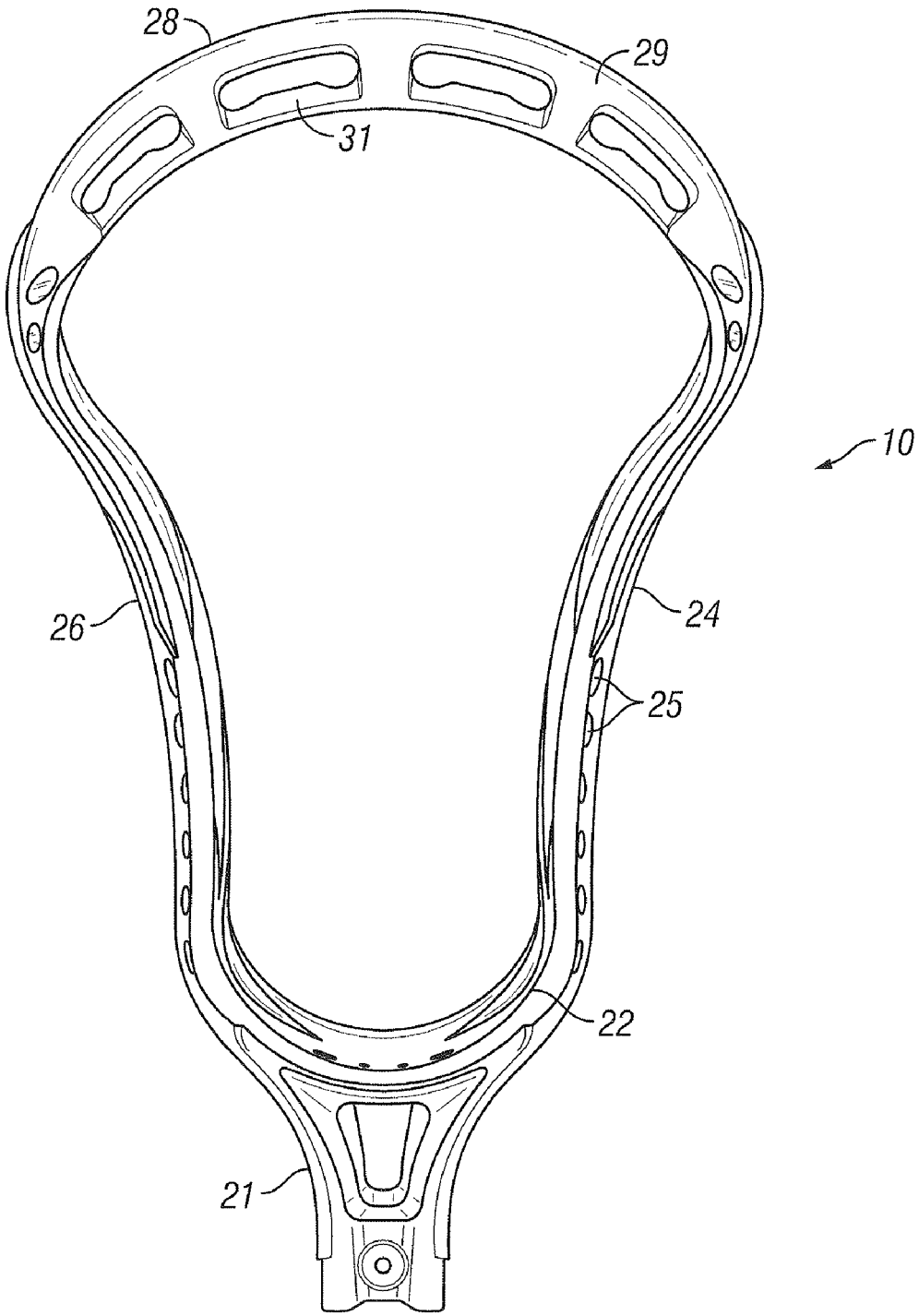
FIG. 2 is a bottom view of a lacrosse head according to an embodiment of the present invention.
Figure 3:
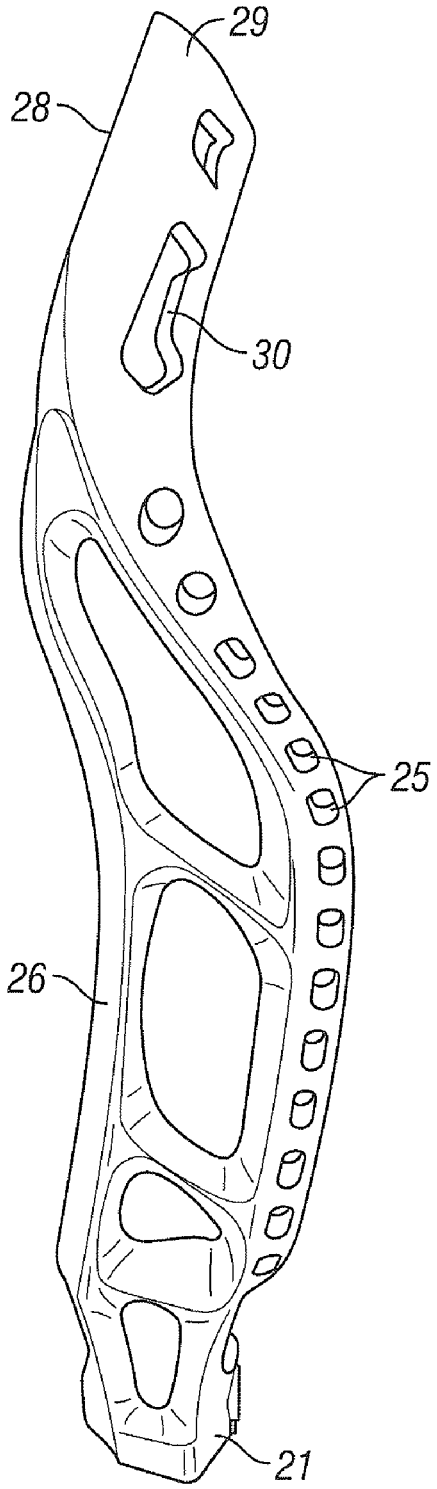
FIG. 3 is a side view of a lacrosse head according to an embodiment of the present invention.

With reference to FIG. 2, one or more recesses 31 may be formed in the outer face 29 of the scoop 28 along the lower edge 34 of an aperture 30. Each recess 31 may correspond to an aperture 30 formed through the scoop 28. In some embodiments, the recesses 31 may be formed such that the net rests properly against the frame 20 during use and/or may facilitate the placement of the net within the apertures 30. In some embodiments, the recesses 31 may further provide desired stiffness properties.

Figure 27:
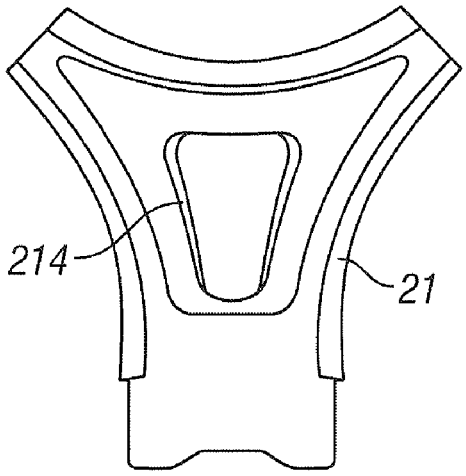
FIG. 27 is a bottom view of a throat portion of a lacrosse head according to an embodiment of the present invention.
Figure 28:
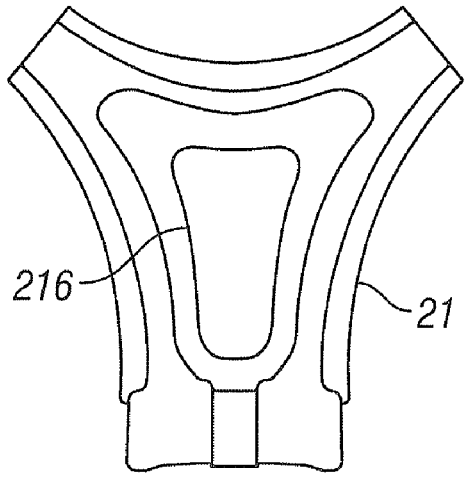
FIG. 28 is a top view of a throat portion of a lacrosse head according to an embodiment of the present invention.

With reference to FIGS. 27 and 28, in one embodiment the lacrosse head 10 includes a back aperture 214 formed in a back side of the throat 21 and a front aperture 216 formed in a front side of the throat 21. The back aperture 214 and the front aperture 216 are formed such that an open-centered void extends through the throat 21 when the head 10 is not attached to a lacrosse shaft. In one embodiment, the back aperture 214 and the front aperture 216 may form a void that is generally perpendicular to the opening 212 of the socket 210 formed in the throat 21 (as shown in FIG. 4). The back aperture 214 and the front aperture 216 may have the same or different shape.

Figure 29:
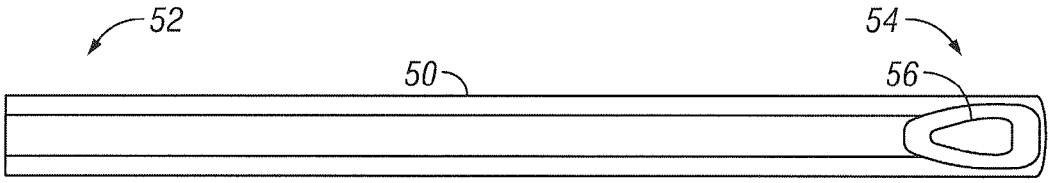
FIG. 29 is a top view of a shaft of a lacrosse stick according to an embodiment of the present invention.
Figure 30:
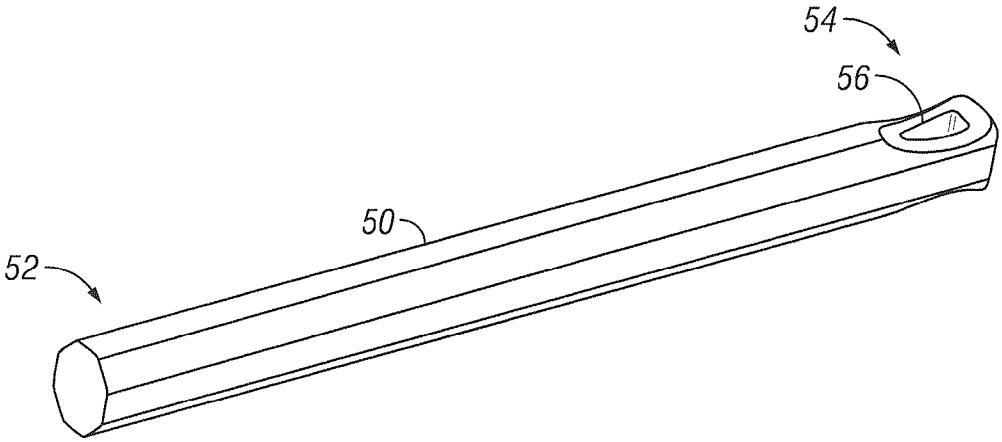
FIG. 30 is a perspective view of a shaft of a lacrosse stick according to an embodiment of the present invention.

With reference to FIGS. 29 and 30, the lacrosse head 10 may be adapted to attach to a shaft 50 to form a lacrosse stick. The lacrosse head 10 may be any suitable lacrosse head and may or may not include apertures 30 in the scoop 28. In one embodiment, the shaft 50 includes a butt end 52 adapted to be held by a player and a head end 54. The head end 54 of the shaft 50 may include a port 56 formed therein. The port 56 may be formed such that a void extends through the head end 54 of the shaft 50. In one embodiment, the shape of the port 56 may be substantially the same as the shape of the back aperture 214 and/or the front aperture 216. As will be appreciated by those of skill in the art, the shaft 50 including the port 56 may be formed using known techniques.

Figure 31:
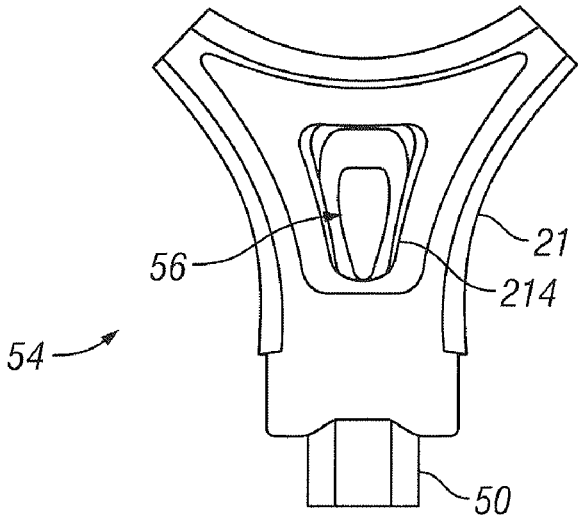
FIG. 31 is a partial bottom view of the throat portion of a lacrosse stick according to an embodiment of the present invention.
Figure 32:
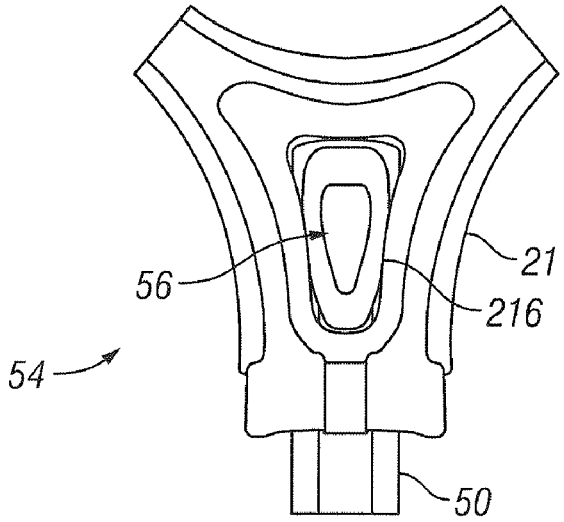
FIG. 32 is a partial top view of the throat portion of a lacrosse stick according to an embodiment of the present invention.

With reference to FIGS. 31 and 32, in one embodiment the lacrosse head 10 may be attached to the shaft 50 to form a lacrosse stick. The lacrosse head 10 may be attached to the shaft 50 with suitable securing means, including, but not limited to, screws and/or adhesive. In an alternative embodiment of the present invention, the lacrosse head 10 and the shaft 50 may be formed as a unitary structure.

When the lacrosse head 10 is attached to the shaft 50, the port 56 is aligned with both the back aperture 214 and the front aperture 216 such that a void extends through both the head 10 and the shaft 50. In one embodiment, a portion of the shaft 50 may be visible through the back aperture 214 and/or the front aperture 216. In some embodiments, the alignment of the port 56 and the back aperture 214 and the front aperture 216 may provide for improved aerodynamics of the lacrosse stick during play.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. For example, in one embodiment, a conventional lacrosse head without apertures formed in the throat portion may be attached to a shaft having a port formed in its head end. One or more support members may be used to support the attachment of the head to the shaft. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A lacrosse head, comprising:

a frame having a base, a pair of sidewalls extending from the base, and a scoop connecting the pair of sidewalls opposite the base, the scoop defining a plurality of apertures for receiving a portion of a net, wherein at least one of the apertures has an upper edge and a lower edge, the lower edge having a first notch, a second notch, and a center portion intermediate to the first notch and the second notch, wherein the first and second, end portions extend below the center portions of the apertures, and wherein the plurality of apertures comprises at least about 30% of the total area of the scoop.

2. The lacrosse head according to claim 1, wherein at least one of the first notch and the second notch is rounded.

3. The lacrosse head according to claim 1, wherein the first notch and the second notch are adapted to receive a portion of the net.

4. The lacrosse head according to claim 1, wherein the plurality of apertures includes a right-most aperture and a left-most aperture, each aperture defined by an upper edge, a lower edge, a right side, and a left side, and wherein the total void area of the plurality of apertures comprises at least about 30% of the total area of the scoop between the left side of the left-most aperture and the right side of the right-most aperture.

5. The lacrosse head according to claim 1, wherein the scoop includes four apertures.

6. The lacrosse head according to claim 1, wherein the plurality of apertures are configured such that the lacrosse head has a lateral stiffness of about 3.5 to about 4 N/mm.

7. The lacrosse head according to claim 1, wherein the plurality of apertures are configured such that the lacrosse head has a vertical stiffness of at least about 13 N/mm.

8. The lacrosse head according to claim 1, wherein the scoop includes an outer scoop surface recessed along the lower edge of the aperture.

9. The lacrosse head according to claim 1, further comprising a throat portion extending from the base, the throat portion having a front portion and a back portion, wherein the front portion defines a front open-centered aperture and the back portion defines a back open-centered aperture, and an opening for axially receiving an end of a lacrosse shaft.

10. The lacrosse head according to claim 1, wherein the center portion intermediate to the first notch and the second notch is substantially flat.

11. The lacrosse head according to claim 1, wherein the center portion intermediate to the first notch and the second notch is rounded.

12. The lacrosse head according to claim 1, wherein the lacrosse head consists essentially of injection molded plastic.

13. The lacrosse head according to claim 1, wherein at least a portion of the scoop defining the aperture is overmolded with a plastic material.

14. A lacrosse head, comprising: a base portion; a pair of sidewalls extending from said base portion; a scoop connecting said pair of sidewalls opposite said base portion, said scoop having an outer surface; and a plurality of apertures formed in said scoop, each of said plurality of apertures having first and second end portions and a center portion intermediate the end portions, wherein the first and second end portions extend below the center portions of the apertures, and wherein the apertures have a void area and the total void area of said plurality of apertures comprises at least about 30% of the total area of said scoop.

15. The lacrosse head according to claim 14, wherein the plurality of apertures includes a right-most aperture and a left-most aperture, each aperture defined by an upper edge, a lower edge, a right side, and a left side, and wherein the total void area of the plurality of apertures comprises at least about 30% of the total area of the scoop between the left side of the left-most aperture and the right side of the right-most aperture.

16. The lacrosse head according to claim 14, wherein the first and second end portions are adapted to receive a portion of a net.

17. The lacrosse head according to claim 14, wherein said scoop includes four apertures.

* * * * *

UNITED STATES PATENT AND TRADEMARK OFFICE

CERTIFICATE OF CORRECTION

PATENT NO. : 8,267,813 B2
APPLICATION NO. : 12/718517
DATED : September 18, 2012
INVENTOR(S) : Vestuti et al.

It is certified that error appears in the above-identified patent and that said Letters Patent is hereby corrected as shown below:

In the Claims:

In claim 1, column 9, line 22, please replace the phrase "wherein the first and second, end portions extend below the center portions of the apertures" with the phrase --wherein the first notch and the second notch extend below the center portion of the aperture--.

Signed and Sealed this
Twenty-first Day of May, 2013

Teresa Stanek Rea
*Acting Director of the United States Patent and Trademark Office*